US005904477A

United States Patent [19]

Van Dam et al.

[11] Patent Number: 5,904,477

[45] Date of Patent: May 18, 1999

[54] BURNER FOR PARTIAL OXIDATION OF A HYDROCARBON-CONTAINING FUEL

[75] Inventors: Reinier Johannes Maria Van Dam; Hendrik Martinus Wentinck, both of Amsterdam, Netherlands

[73] Assignee: Shell Oil Company, Houston, Tex.

[21] Appl. No.: 08/720,843

[22] Filed: Oct. 3, 1996

[30] Foreign Application Priority Data

Oct. 5, 1995 [EP] European Pat. Off. ..... 95202680

[51] Int. Cl.[6] ..... F23D 11/00

[52] U.S. Cl. ..... 431/159; 431/160; 431/353; 239/132.3

[58] Field of Search ..... 431/159, 160, 431/353; 239/137.3, 433, 288.3, 600, 132, 132.1, 288, 288.5

[56] References Cited

U.S. PATENT DOCUMENTS

| | | | |
|---|---|---|---|
| 2,368,178 | 1/1945 | Turpin | 431/153 |
| 3,874,592 | 4/1975 | Buschmann et al. | 239/132.3 |
| 4,155,704 | 5/1979 | Kulabukhov et al. | 431/153 X |
| 4,523,529 | 6/1985 | Poll | 110/263 |
| 4,666,397 | 5/1987 | Wenning et al. | 431/160 |
| 4,887,962 | 12/1989 | Hasenack et al. | 431/160 |
| 4,952,218 | 8/1990 | Lipp et al. | 239/132.3 X |
| 5,199,866 | 4/1993 | Joshi et al. | 431/353 |
| 5,273,212 | 12/1993 | Gerhardus et al. | 29/132.3 |
| 5,449,226 | 9/1995 | Snyder et al. | 431/9 |

FOREIGN PATENT DOCUMENTS 0 312 133 A1 4/1989 European Pat. Off. ..... F23D 11/40

*Primary Examiner*—Larry Jones

[57] ABSTRACT

A non-water cooled burner is provided for preparation of synthesis gas by partial oxidation of hydrocarbon-containing fuel and an oxygen-containing gas applied as oxidiser. The burner comprises a burner head and an arrangement of passages or channels for feeding the fuel and oxidiser and optionally a moderator gas to a reactor. The burner head is provided with a non-ceramic lining or thin-walled mantle mounted at its one end on the burner head and its other end directed to the reactor and surrounding the passages. The non-ceramic lining is externally provided with a protection shield against hot synthesis gas, the protection shield comprising a plurality of separate ceramic members which join sideways at least partially in such a manner that the non-ceramic lining at its the other end is encircled over a determined part of its length by the plurality of separate ceramic members. The plurality of ceramic members is fixed on the non-ceramic lining.

20 Claims, 3 Drawing Sheets

BURNER FOR PARTIAL OXIDATION OF A HYDROCARBON-CONTAINING FUEL

FIELD OF THE INVENTION

The invention relates to a burner for partial oxidation of a hydrocarbon-containing fuel.

In particular, the invention relates to a burner for the manufacture of synthesis gas by partial oxidation of a hydrocarbon-containing fuel wherein an oxygen-containing gas applied as oxidiser and a hydrocarbon-containing fuel are supplied to a gasification zone through an arrangement of passages or channels for fuel and oxidiser, and wherein autothermically a gaseous stream containing synthesis gas is produced under appropriate conditions.

BACKGROUND

Synthesis gas is a gas comprising carbon monoxide and hydrogen, and it is used, for example, as a fuel gas or as a feedstock for the synthesis of methanol, ammonia or hydrocarbons, which latter synthesis yields gaseous hydrocarbons and liquid hydrocarbons such as gasoline, middle distillates, lub oils and waxes.

The oxygen-containing gas applied as oxidiser is usually air or (pure) oxygen or steam or a mixture thereof. Further, in order to control the temperature in the gasification zone a moderator gas (for example, steam, water or carbon dioxide or a combination thereof) can be supplied to the zone. Those skilled in the art will know the conditions of applying oxidiser and moderator gas.

Further, the gasification process can be carried out at any suitable pressures, for example at 0.1–12 MPa abs.

In particular, the invention relates to a burner as described in the foregoing, wherein a hydrocarbon-containing liquid or gas is applied as fuel.

For example, (heavy) residue feedstock or natural gas can be used as fuel.

According to an established process, synthesis gas is produced by partially oxidising in a reactor vessel a fuel such as liquid hydrocarbon, in particular heavy oil residue, at a temperature in the range of from 1000° C. to 1800° C. and at a pressure in the range of from 0.1 MPa to 6 MPa abs. with the of an oxygen containing gas.

Synthesis gas will often be produced near or at a crude oil refinery because the produced synthesis gas can directly be applied as a feedstock for the production of middle distillates, ammonia, hydrogen, methanol or as a fuel gas, for example, for heating the furnaces of the refinery or more efficiently for the firing of gas turbines to produce electricity and heat.

It is known to apply burners in partial oxidation processes of hydrocarbon-containing fuel which are provided with cooling channels and are cooled by a cooling fluid (e.g. water) flowing through the channels. Reference can e.g. be made to EP-A-0,545,281 disclosing a multi-orifice burner applicable in partial oxidation processes of hydrocarbon-containing fuel which comprises three or more concentrically arranged tubes, having a conical tapering at the burner exit and hollow wall members with internal cooling fluid (e.g. water) passages. A cooling chamber for cooling fluid is arranged in the rear of the burner surrounding the burner exit.

The rear side is covered with a layer of ceramic plates arranged next to one another.

However, the capital expenditure and maintenance of a fail safe water-cooled system is significant. Further, it has appeared that in large burners problems arise with respect to withstanding the cooling water pressure when the reactor pressure is at ambient.

Instead of comprising internal cooling fluid passages, burners may be provided with a suitable ceramic or refractory lining applied onto or suspended by a means closely adjacent to the outer surface of the burner (front) wall for resisting the heat load during operation or heat-up/shut down situations of the burner.

Reference can e.g. be made to EP-A-0,312,133 disclosing a ceramic burner for use in partial oxidation processes of hydrocarbon-containing fuel.

This known burner comprises a burner head which is provided with a ceramic burner mantle protruding into a reactor through a refractory dome. The mantle is connected at one of its ends to the burner head and the protruding mantle separates the burner internals from the reactor environment. There are no separate channels for cooling fluid such as water.

However, it has appeared that the lifetime of this known burner is restricted, since the ceramic mantle is not able to stand thermal stresses and the ceramic material goes to pieces after starting-up the burner. Further, the choice of the ceramic material is critical, only a limited number of ceramic materials can be applied.

It is an object of the invention to provide a burner with a long lifetime which does not require separate cooling channels or passages for cooling fluid and which has virtually no scale-up limitations, is relatively cheap and virtually maintenance-free.

It is another object of the invention to provide such a burner which can operate at severe reactor conditions and limits the heat flux from the flame in front of the burner to the reactor dome and wherein the choice of ceramic materials is not restricted to specific ceramics.

SUMMARY OF THE INVENTION

The present invention therefore provides a burner for preparation of synthesis gas by partial oxidation of hydrocarbon-containing fuel and an oxygen-containing gas applied as oxidiser, the burner comprising a burner head and an arrangement of passages or channels for feeding the fuel and oxidiser and optionally a moderator gas to a reactor, in the absence of separate cooling passages or channels for cooling fluid, wherein the burner head is provided with a non-ceramic lining or thin-walled mantle mounted at its one end on the burner head and its other end being directed to the reactor and surrounding the passages, and wherein the other end of the non-ceramic lining externally is provided with a protection shield against hot synthesis gas, the protection shield comprising a plurality of separate ceramic members which join sideways at least partially in such a manner that the non-ceramic lining at its the other end is encircled over a determined part of its length by the plurality of separate ceramic members and wherein the plurality of separate ceramic members is fixed on the non-ceramic lining.

DETAILED DESCRIPTION

It has now been found that by the use of a protection shield comprising a plurality of separate ceramic members the choice of the ceramic material is less critical and that a substantial variety of ceramic materials can be applied. Further, it has appeared that the burner of the invention has an increased life-time.

The invention will now be described by way of example in more detail by reference to the accompanying drawings.

Figure 1:
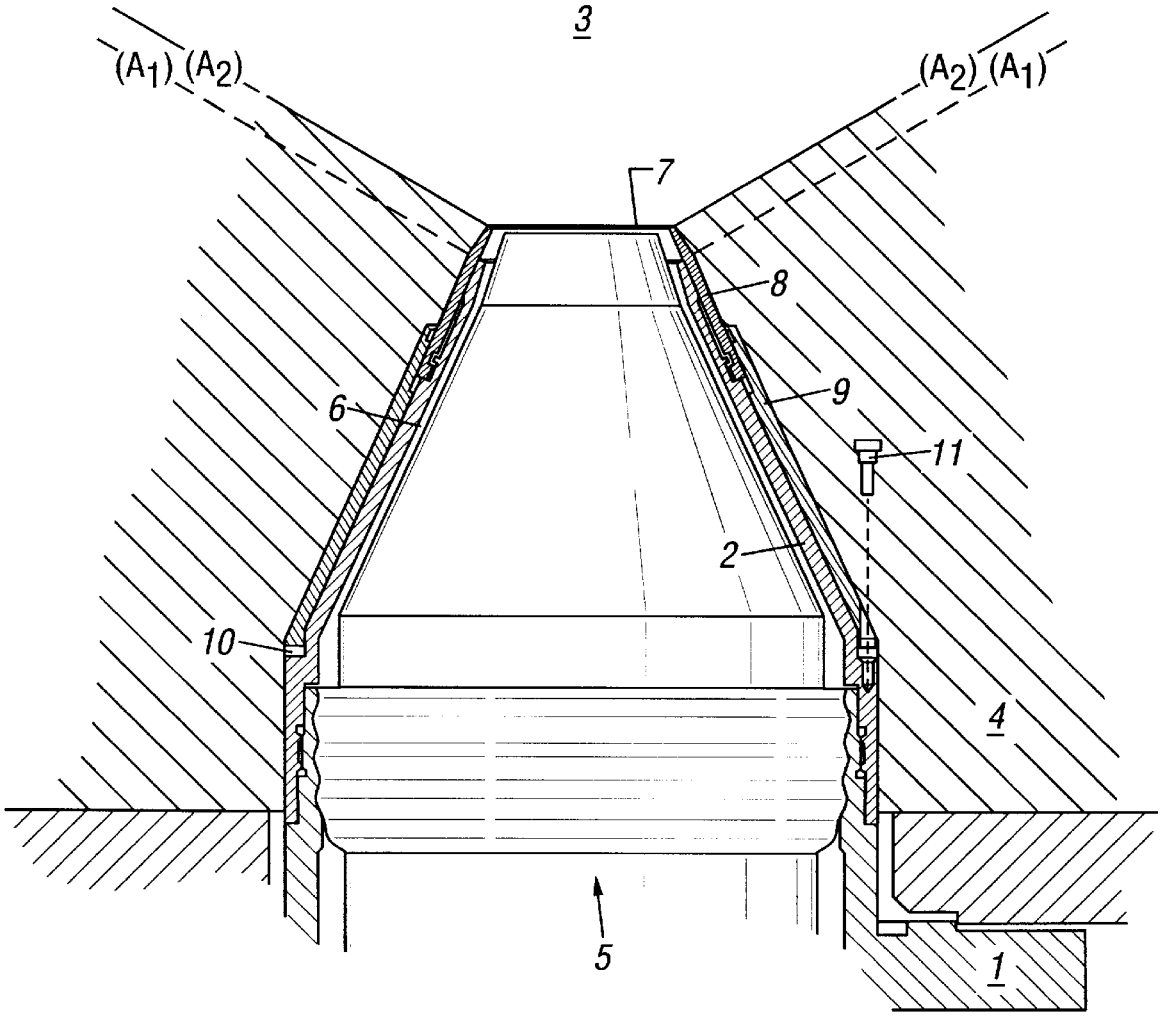
FIG. 1 represents schematically a sectional view of a burner according to the invention.

Referring now to FIG. 1, the burner comprises a burner head 1 which is provided with a non-ceramic (e.g. metal) burner lining or thin-walled mantle 2 and is debouching with a burner exit 7 into a reactor gasification zone 3 through a refractory dome 4. The metal lining or mantle 2 is connected at one of its ends to the burner head in any way suitable for the purpose. In FIG. 1 the lining or mantle 2 has a substantially conical shape but it will be appreciated by those skilled in the art that any shape suitable for the purpose (e.g. substantially cylindrical) is possible. The non-ceramic lining or mantle 2 separates the burner internals 5 from the reactor environment.

The burner internals 5 comprise an arrangement of channels or passages and have not been shown in detail for reasons of clarity (only the outer passage 6 has been partially shown).

The fuel, oxidiser and, optionally, moderator gas are supplied to the gasification zone through the arrangement of passages.

Through the outer passage 6 only fuel and/or moderator are supplied and not oxidiser, for the purpose of cooling the ceramic member 8. Advantageously, the arrangement of the non-ceramic lining 2 and the ceramic member 8, is non-flush, as represented in FIG. 1. However, it will be appreciated by those skilled in the art, that a flush-arrangement of the lining 2 and the member 8 (not shown in FIG. 1 for reasons of clarity) is not excluded.

Advantageously, the burner comprises an arrangement of annular concentric channels or passages for supplying oxidiser, moderator gas (optionally) and fuel to a gasification zone (multi-orifice burner).

Such multi-orifice burners comprise a number of slits at the burner exit. The passages may or may not be converging at the burner exit. Advantageously, the exit(s) of one or more passages may be retracted or protruded with respect to the outer passage.

It will be appreciated by those skilled in the art that any slit width suitable for the purpose can be applied, dependent on the burner capacity.

Advantageously, the central passage has a diameter up to 70 mm, whereas the remaining concentric passages have slit widths in the range of 1–20 mm.

However, it will be appreciated that the invention is not restricted to the use of co-annular burners.

The oxidiser and the fuel and, optionally, moderator gas are supplied to the gasification zone through the respective channels at specific velocities and mass distribution in order to obtain a good atomization and mixing.

In an advantageous embodiment of the invention the respective velocities are measured or calculated at the outlet of the respective channels into the gasification zone. The velocity measurement or calculation can be carried out by those skilled in the art in any way suitable for the purpose and will therefore not be described in detail.

The non-ceramic lining 2 is at its end directed to the reactor externally provided with a protecting shield comprising a plurality of separate ceramic members 8 which will be represented more clearly in FIGS. 2, 3, 4*a* and 4*b*. The members 8 are fixed in any suitable manner on the (metal) mantle 2 e.g. externally by a clamping means 9. The clamping means 9 is e.g. welded (10) or screwed (11) on the lining 2. The separate ceramic members 8, which are advantageously bar-shaped, join sideways at least partially in such a manner that the non-ceramic lining 2 at its end directed to the reactor is encircled over a determined part of its length by the plurality of ceramic members 8. The gaps between the joining parts are less than 1 mm, and in particular less than 0.1 mm. In operation of the burner, at least part of the outer skin of the ceramic member 8 is exposed to the reactor environment and its inner skin is cooled by at least one of the feed streams (fuel, moderator gas) via the outer passage 6. Advantageously, steam and/or natural gas is passing through the outer passage 6 with a velocity of 30–100 m/s. The burner fluid dynamics are selected in such a manner that the conversion of the reactor is optimal. Those skilled in the art will know the conditions of such a selection.

Advantageously, the burner exit 7 protrudes in the reactor with respect to the refractory dome 4 (as represented in FIG. 1 by the line A1) to reduce direct radiant heat transfer from the flame to the refractory dome surrounding the burner. It will be appreciated by those skilled in the art that in an advantageous alternative embodiment the burner exit is in flush arrangement with the refractory dome (as represented in FIG. 1 by the line A2).

The mechanical connection between ceramic member 8 and metal lining 2 of the burner should allow different thermal expansion of the metal and ceramic parts, while being substantially gastight.

Suitable ceramics having a large heat conductivity coefficient are for example silicon carbides and zirconium oxide based alloys. Such materials are also sufficiently corrosion-resistant.

It will be appreciated that in order to reduce thermo-mechanical stress an advantageous wall thickness of the lining 2 is in the range of 2 to 8 mm, more advantageously 5 mm.

It will further be appreciated that the lining 2 can have any dimensions suitable for the purpose. Advantageously its length and diameter are in the range of 20 to 40 cm and in the range of 8 to 16 cm respectively, whereas its protrusion into the reactor is in the range of 1 to 5 cm and, in particular, 2 cm.

Figure 2:
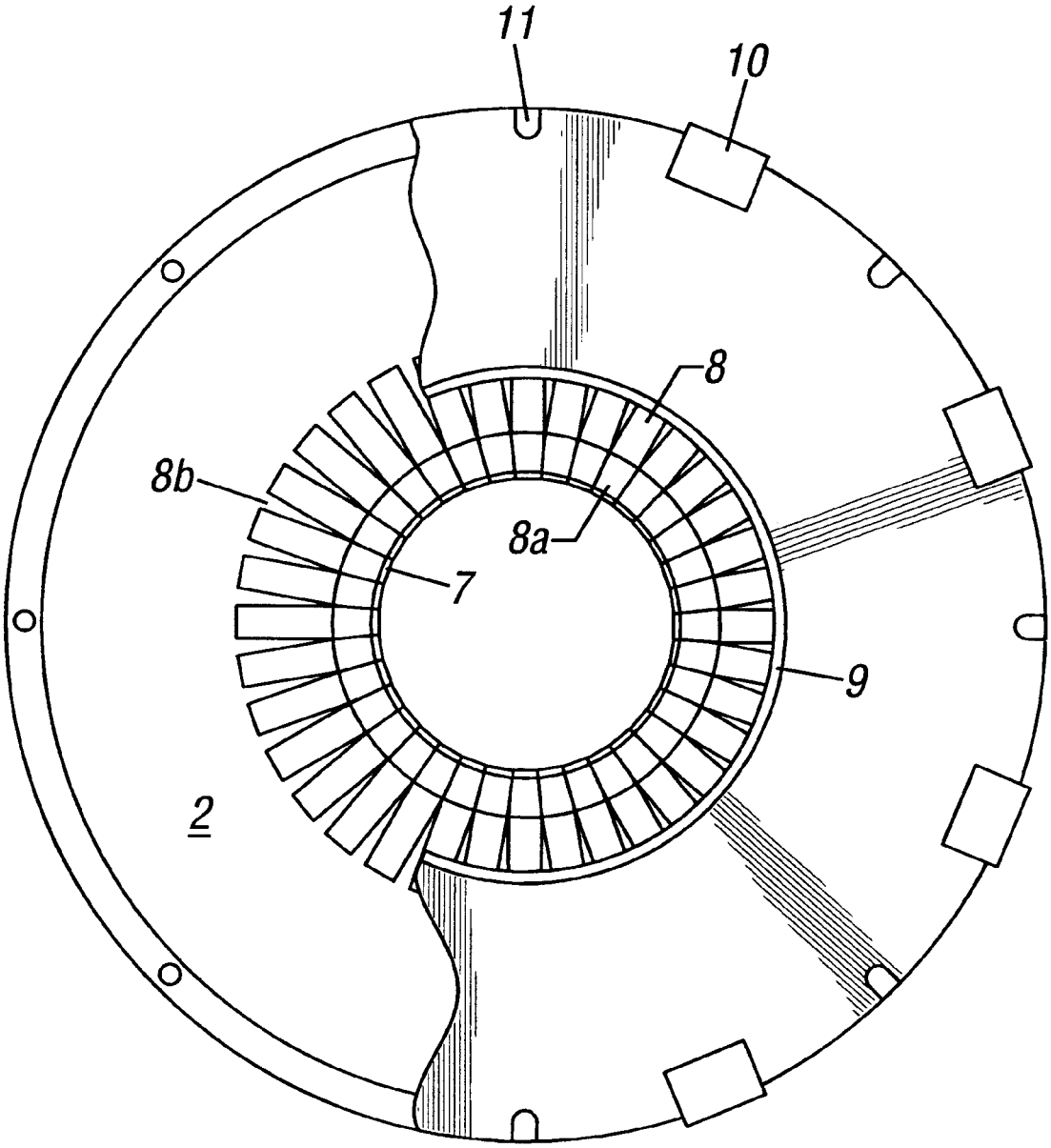
FIG. 2 represents a top view of the burner of FIG. 1.
Figure 3:
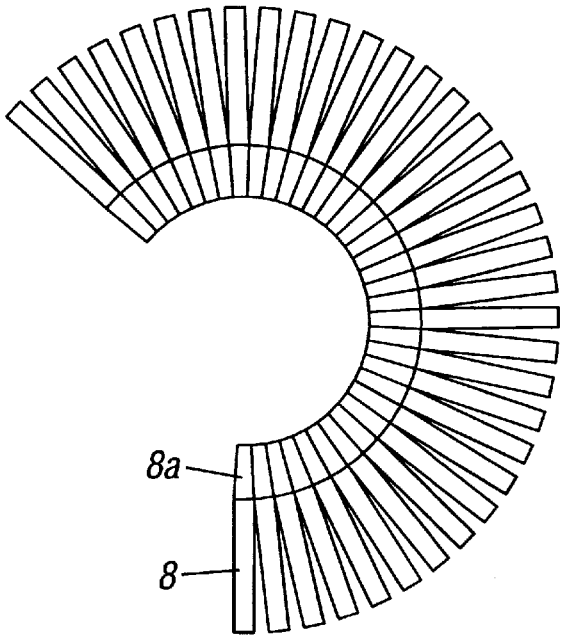
FIG. 3 represents a partial top view of a detail of FIG. 2.
Figure 4A:
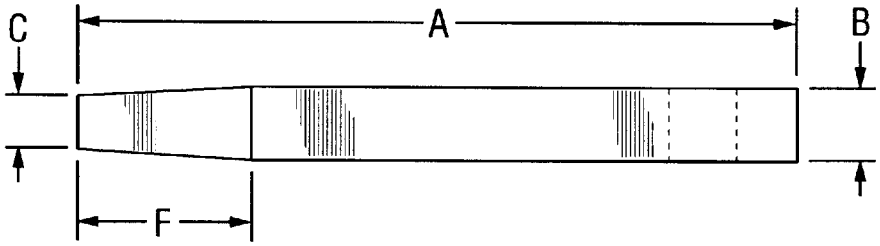
FIGS. 4*a,b* represent a top view and a side view, respectively, of a detail of FIG. 3.

The same reference numerals as in FIG. 1 have been used in FIGS. 2, 3 and 4*a, b* to represent the same parts.

In FIG. 2 looking towards the burner exit 7, separate ceramic bars 8 are shown, joining sideways partially thus forming a plurality of ceramic bars which are clamped around the outer (metal) burner lining 2 by a clamping means 9 and form a protection shield against hot synthesis gas. The clamping means 9 is e.g. welded (10) or screwed (11) on the lining 2 as already described in the foregoing and form a truncated cone. In FIG. 2 the protection shield has a substantially conical shape and the ceramic bars 8 form a segmented burner lining on top of the (metal) lining 2. However, it will be appreciated by those skilled in the art that the invention is not restricted thereto. In case of a tapered burner and therefore a conical protection shield the ceramic bars 8 have necessarily a tapered end 8*a* in order to form a substantially annular member, leaving a gap 8*b* between adjacent ceramic bars 8 at their ends directed to the burner head.

However, in case of a cylindrical burner the ceramic bars have no tapered end and join sideways along their full lengths.

In FIG. 3 the annular assembly of ceramic bars 8 is shown partially in more detail.

Figure 4B:
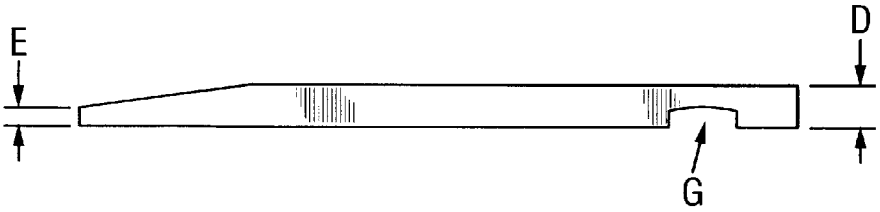

FIGS. 4*a* and 4*b* represent a top view and a side view respectively of a separate ceramic bar-shaped member 8 of FIG. 3. The bar-shaped member is tapered at one end. Advantageous dimensions are as follows:

A: 5–15 cm;

B: 5–20 mm, in particular 10 mm;

C: 3–18 mm, is dependent on number of bars, cone diameter and cone angle; in particular 6–9 mm;

D: 2–8 mm, in particular 5 mm;

E: 0.5–5 mm, in particular 2 mm;

F: 1–3 cm.

Advantageously, the number of bar-shaped segments is 10–50.

The depression G can have any dimensions suitable for the purpose. It will be appreciated by those skilled in the art that this depression can be omitted.

Various modifications of the present invention will become apparent to those skilled in the art from the foregoing description. Such modifications are intended to fall within the scope of the appended claims.

What is claimed is:

1. A burner for preparation of synthesis gas by partial oxidation of hydrocarbon-containing fuel and an oxygen-containing gas applied as oxidiser, said burner comprising a burner head and an arrangement of passages or channels for feeding the fuel and oxidiser and optionally a moderator gas to a reactor, wherein said burner does not have separate passages or channels for cooling fluid, wherein the burner head is provided with a non-ceramic lining or thin-walled mantle mounted at its one end on the burner head and its other end being directed to the reactor and surrounding said passages, and wherein said other end of said non-ceramic lining externally is provided with a protection shield against hot synthesis gas, said protection shield comprising a plurality of separate ceramic members which join sideways at least partially in such a manner that said non-ceramic lining at its said other end is encircled over a determined part of its length by said plurality of separate ceramic members, and wherein said plurality of separate ceramic members is fixed on said non-ceramic lining.

2. The burner as claimed in claim 1, wherein said non-ceramic lining is made of metal.

3. The burner as claimed in claim 1, wherein said plurality of separate ceramic members is externally fixed on the non-ceramic lining.

4. The burner as claimed in claim 1, wherein said ceramic members are made of mainly zirconium oxide based alloys.

5. The burner as claimed in claim 1, wherein said ceramic members are made of mainly silicon carbide.

6. The burner as claimed in claim 1, wherein the thickness of the wall of the non-ceramic lining is in the range of 2 to 8 mm.

7. The burner as claimed in claim 1, wherein the non-ceramic lining has a length in the range of 20 to 40 cm and a diameter in the range of 8 to 16 cm, and wherein said burner protrudes into the reactor in the range of 1 to 5 cm.

8. The burner as claimed in claim 1, wherein said protection shield is substantially conically shaped.

9. The burner as claimed in claim 1, wherein said plurality of separate ceramic members comprises 10–50 ceramic members.

10. The burner as claimed in 1, wherein the ceramic members are bar-shaped.

11. The burner as claimed in claim 3, wherein said plurality of separate ceramic members is fixed to the non-ceramic lining by a clamp means.

12. The burner as claimed in claim 11, wherein the clamp means is a truncated cone.

13. The burner as claimed in claim 1, wherein said protection shield is substantially cylindrical.

14. The burner as claimed in claim 1, wherein the non-ceramic lining separates an outer burner passage for hydrocarbon-containing fuel and/or moderator gas from said protection shield.

15. The burner as claimed in claim 14, wherein said passage is a steam slit, a natural gas slit, or both; and wherein, in operation of the burner, natural gas passes in said passage with a velocity of 30–100 m/s.

16. The burner as claimed in claim 14, wherein said passage is a steam slit, a natural gas slit, or both; and wherein, in operation of the burner, steam and natural gas pass in said passage with a velocity of 30–100 m/s.

17. The burner as claimed in claim 14, wherein said passage is a steam slit, a natural gas slit, or both; and wherein, in operation of the burner, steam passes in said passage with a velocity of 30–100 m/s.

18. The burner as claimed in claim 1, wherein said protection shield protrudes with respect to the non-ceramic lining.

19. The burner as claimed in claim 18, wherein said protrusion is 1–5 cm.

20. The burner as claimed in claim 19, wherein said protrusion is 2 cm.

* * * * *